US011118523B2

(12) United States Patent
Hosaka et al.

(10) Patent No.: US 11,118,523 B2
(45) Date of Patent: Sep. 14, 2021

(54) CONTROL DEVICE

(71) Applicant: Hitachi Automotive Systems, Ltd., Hitachinaka (JP)

(72) Inventors: Tomoyuki Hosaka, Tokyo (JP); Taisuke Sugii, Tokyo (JP); Eiji Ishii, Tokyo (JP); Yoshihiro Sukegawa, Tokyo (JP); Masayuki Saruwatari, Hitachinaka (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 0 days.

(21) Appl. No.: 16/328,866

(22) PCT Filed: Aug. 2, 2017

(86) PCT No.: PCT/JP2017/027987
§ 371 (c)(1),
(2) Date: Feb. 27, 2019

(87) PCT Pub. No.: WO2018/061470
PCT Pub. Date: Apr. 5, 2018

(65) Prior Publication Data

US 2019/0211763 A1 Jul. 11, 2019

(30) Foreign Application Priority Data

Sep. 28, 2016 (JP) ..... JP2016-188988

(51) Int. Cl.
*F02D 41/26* (2006.01)
*F02D 45/00* (2006.01)
(Continued)

(52) U.S. Cl.
CPC ..... *F02D 41/06* (2013.01); *F02D 41/32* (2013.01); *F02D 41/34* (2013.01); *F02D 45/00* (2013.01); *F02B 2075/125* (2013.01)

(58) Field of Classification Search
CPC ..... F02D 41/06; F02D 41/064; F02D 41/30; F02D 41/3094; F02D 41/32; F02D 41/34;
(Continued)

(56) References Cited

U.S. PATENT DOCUMENTS 6,708,661 B1 3/2004 Aubourg et al.
2009/0082942 A1 3/2009 Ohsaki et al.
(Continued)

FOREIGN PATENT DOCUMENTS

CN 102207052 A 10/2011
JP 2003-514186 A 4/2003
(Continued)

OTHER PUBLICATIONS

International Search Report with English Translation and Written Opinion issued in corresponding application No. PCT/JP2017/027987, dated Dec. 5, 2017.
(Continued)

*Primary Examiner* — John Kwon
*Assistant Examiner* — Johnny H Hoang
(74) *Attorney, Agent, or Firm* — Foley & Lardner LLP

(57) ABSTRACT

Provided is a fuel injection device and a control unit therefor which enable reliable ignition even in a case where fuel pressure is low immediately after starting an engine. In the control unit for controlling an injector injecting fuel into an internal combustion engine, a plurality of injectors is provided in the internal combustion engine, a static flow rate of a first injector is configured to be smaller than a static flow rate of a second injector. In a case where a fuel pressure of fuel supplied by a pressurizing unit is lower than a set value set lower than a fuel pressure in warming up, an injection ratio of the first injector is controlled to increase according to a difference between a fuel pressure of fuel from the pressurizing unit and a fuel pressure in warming up.

2 Claims, 6 Drawing Sheets

(51) Int. Cl.

| | |
|---|---|
| ***F02D 41/06*** | (2006.01) |
| ***F02D 41/34*** | (2006.01) |
| ***F02D 41/32*** | (2006.01) |
| *F02B 75/12* | (2006.01) |

(58) Field of Classification Search
CPC ..... F02D 45/00; F02D 2200/021; F02D 2200/0602; F02B 2075/125
See application file for complete search history.

(56) References Cited

U.S. PATENT DOCUMENTS

| | | | | |
|---|---|---|---|---|
| 2011/0283974 | A1 | 11/2011 | Baeuerle et al. | |
| 2013/0000605 | A1 | 1/2013 | Tomiita et al. | |
| 2015/0369162 | A1 | 12/2015 | Cohn et al. | |
| 2016/0153391 | A1* | 6/2016 | Ranga | F02D 41/1454 701/104 |
| 2016/0169147 | A1 | 6/2016 | Surnilla et al. | |
| 2016/0177860 | A1* | 6/2016 | Pursifull | F02B 43/12 123/294 |
| 2017/0002754 | A1* | 1/2017 | Oh | F02D 41/401 |
| 2018/0066598 | A1* | 3/2018 | Dusa | F02D 41/064 |
| 2018/0171936 | A1* | 6/2018 | McQuillen | F02M 25/03 |
| 2018/0223761 | A1* | 8/2018 | Hirchenhein | F02D 41/3809 |

FOREIGN PATENT DOCUMENTS

| | | | |
|---|---|---|---|
| JP | 2003-262174 | A | 9/2003 |
| JP | 2004-068762 | A | 3/2004 |
| JP | 2007-092717 | A | 4/2007 |
| JP | 2009-074440 | A | 4/2009 |
| JP | 2010-048179 | A | 3/2010 |
| JP | 2010-196506 | A | 9/2010 |
| JP | 4541500 | B2 | 9/2010 |
| JP | 2011-190741 | A | 9/2011 |
| JP | 2015-075023 | A | 4/2015 |
| WO | WO-2014/167832 | A1 | 10/2014 |

OTHER PUBLICATIONS

Extended European Search Report issued in corresponding European Patent Application No. 17855428.3 dated Aug. 12, 2020.
Office Action issued in corresponding Chinese Patent application No. 201780038104.3 dated Dec. 28, 2020, with partial English translation.

* cited by examiner (a)

(b)

CONTROL DEVICE

TECHNICAL FIELD

The present invention relates to a control unit for a fuel injection valve used for an internal combustion engine such as a gasoline engine.

BACKGROUND ART

There is an increasing demand for improving fuel economy of gasoline engines in automobiles, and, as an engine with excellent fuel economy, a gasoline direct injection engine has been widespread in which fuel is directly injected into a combustion chamber, an air-fuel mixture of the injected fuel and intake air is ignited by a spark plug to explode the air-fuel mixture. However, the gasoline direct injection engine has a small distance from an injection point to a wall surface and fuel tends to adhere on the inside of the combustion chamber. Inhibition of particulate matter (PM) generated by incomplete combustion of fuel adhering on a low-temperature wall surface is demanded. In order to solve this problem and to develop a gasoline direct injection engine with low fuel consumption and low exhaust gas, it is necessary to optimize combustion in a combustion chamber.

Furthermore, more, driving of an automobile has various driving situations, such as high-load driving, low-load driving, cold start. For this reason, it is necessary for the gasoline direct injection engine to perform optimum combustion depending on the driving situations. In view of this, a method has been proposed to more finely control a plurality of injectors provided for each cylinder and directly injecting fuel into a combustion chamber. For example, PTL 1 describes a technique including two injectors for one cylinder.

In addition, in the gasoline direct injection engine, the internal temperature of the engine is low immediately after starting, and it is difficult to vaporize fuel. Therefore, fuel having an air-fuel mixture density exceeding a theoretical air-fuel mixture density is needed to perform ignition. In contrast, PTL 2 discloses a technique for increasing the pressure of fuel upon starting an engine to atomize the fuel, improving starting performance.

CITATION LIST

Patent Literature

PTL 1: JP 2010-196506 A
PTL 2: JP 2003-514186 A

SUMMARY OF INVENTION

Technical Problem

In the technique disclosed in PTL 2, injection of high-pressure fuel when the temperature of the engine is lower than a predetermined temperature threshold enables atomization of the fuel and improvement of starting performance.

However, in the technique disclosed in PTL 2, it takes a certain time to pressurize fuel, the fuel cannot be injected before the pressure of the fuel is increased, and there is a fear that it may take time for starting an engine.

In view of the above problems, an object of the present invention is to provide a fuel injection device and a control unit therefor which enable reliable ignition even when the pressure of fuel (fuel pressure) is low immediately after starting an internal combustion engine.

Solution to Problem

In order to solve the above problems, a control unit for a fuel injection device according to the present invention controls an internal combustion engine including a plurality of injectors to monitor a fuel pressure of fuel supplied from a pressurizing unit, when a static flow rate of a first injector is smaller than a static flow rate of another injectors so that an injection ratio of fuel from the first injector is increased according to a difference between the fuel pressure and a fuel pressure in warming up, in a case where the fuel pressure is lower than a predetermined fuel pressure set lower than that in the warm-up operation.

Advantageous Effects of Invention

According to the present invention, even when the fuel pressure immediately after starting is low, reliable ignition can be achieved.

DESCRIPTION OF EMBODIMENTS

Hereinafter, embodiments according to the present invention will be described.

First Embodiment

Figure 1:
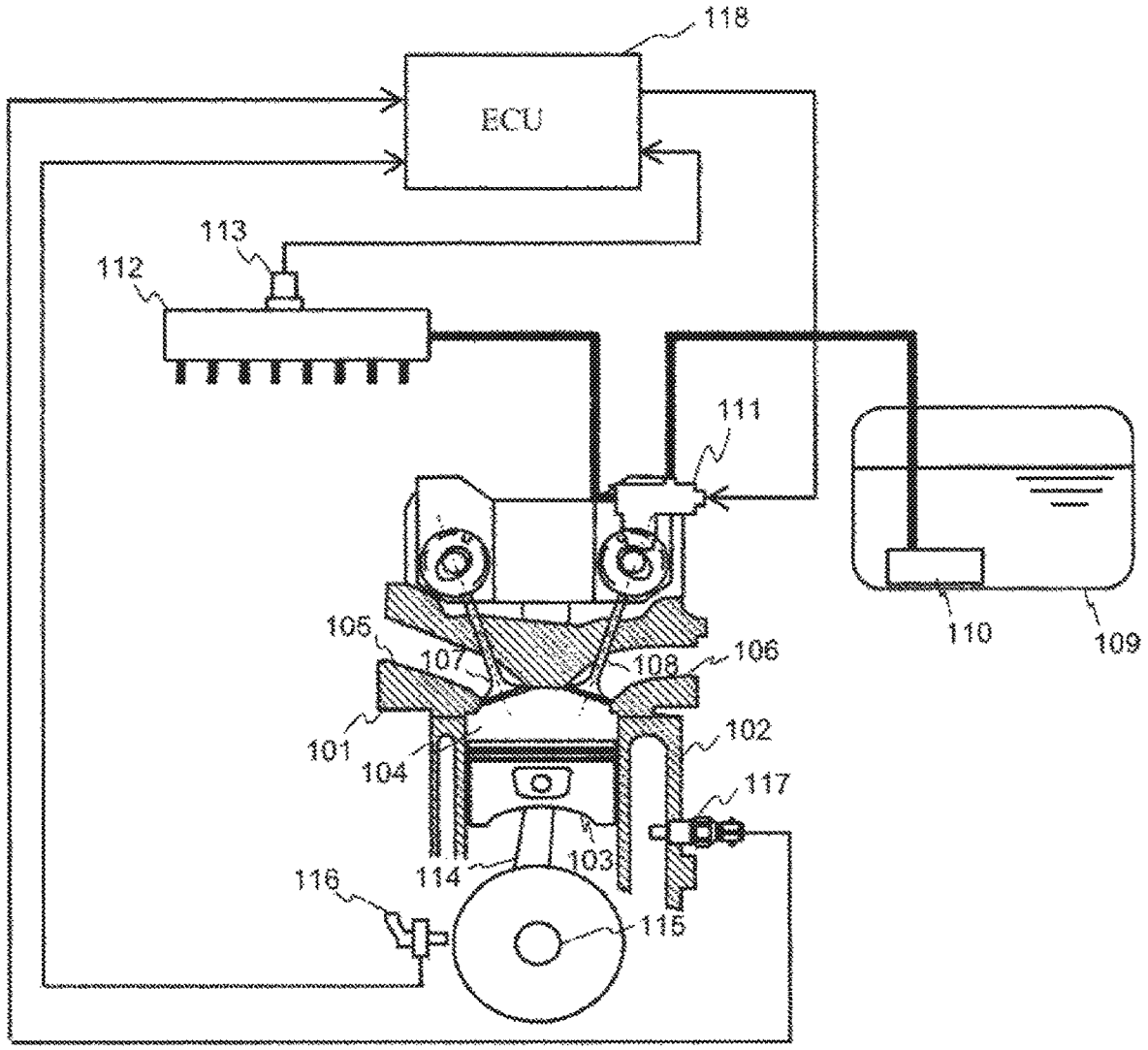
FIG. 1 is a diagram illustrating an outline of a configuration of an internal combustion engine according to the present invention.

A control unit for an injector (fuel injection valve) according to a first embodiment of the present invention will be described below with reference to FIGS. 1 and 2. FIG. 1 is a diagram illustrating an outline of a configuration of a gasoline direct injection engine. The basic operation of the gasoline direct injection engine will be described with reference to FIG. 1. In FIG. 1, a combustion chamber 104 is defined by a cylinder head 101, a cylinder block 102, and a piston 103 inserted into the cylinder block 102. An intake pipe 105 and an exhaust pipe 106 are divided into two respectively and connected to the combustion chamber 104. An intake valve 107 is provided in an opening portion of the intake pipe 105, and an exhaust valve 108 is provided in an opening portion of the exhaust pipe 106, and the valves are operated so as to be opened and closed by cam operation.

The piston 103 is connected to a crankshaft 115 via the connecting rod 114, and the crank angle sensor 116 can detect the engine speed. A value of the engine speed is sent to an ECU (engine control unit) 118. A non-illustrated starter motor is connected to the crankshaft 115, and when the engine is started, the crankshaft 115 can be rotated by the starter motor and started. A water temperature sensor 117 is provided in the cylinder block 102, and it is possible to detect the temperature of non-illustrated engine cooling water. The temperature of the engine cooling water is sent to the ECU 118.

Although FIG. 1 illustrates only one cylinder, a non-illustrated collector is provided upstream of the intake pipe 105 to distribute air for each cylinder. An air flow sensor and a non-illustrated throttle valve are provided upstream of the collector, and the amount of air sucked into the combustion chamber 104 can be adjusted according to the degree of opening of the throttle valve.

Fuel is stored in the fuel tank 109 and sent to a high-pressure fuel pump 111 by a feed pump 110. The feed pump 110 raises the pressure of the fuel up to about 0.3 MPa and sends the fuel to the high-pressure fuel pump 111. The fuel, the pressure of which is raised by the high-pressure fuel pump 111, is sent to the common rail 112. The high-pressure fuel pump 111 raises the pressure of the fuel up to about 30 MPa and sends the fuel to the common rail 112. A fuel pressure sensor 113 is provided at the common rail 112 to detect the pressure of the fuel (fuel pressure). A value of the fuel pressure is sent to the ECU 118.

Figure 2:
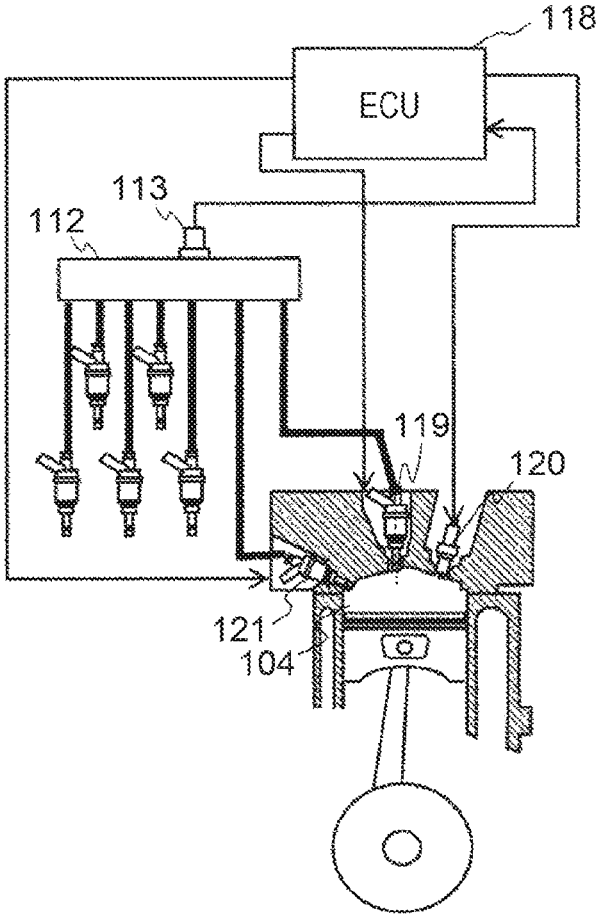
FIG. 2 is a cross-sectional view of a configuration at the center of a cylinder of an internal combustion engine according to a first embodiment of the present invention.

FIG. 2 is a cross-sectional view of a configuration at the center of a cylinder of the gasoline direct injection engine. A first injector 119 is provided at an upper portion in the axis direction and at the center portion in a radial direction of the cylinder. Furthermore, a second injector 121 is provided on a side surface portion in a radial direction. A spark plug 120 is provided in the vicinity of the exhaust pipe 106. The ECU 118 monitors signals from the sensors and controls the operations of the devices, such as the first injector 119, the spark plug 120, and the high-pressure fuel pump 111. In a ROM of the ECU 118, setting values of various devices according to engine speed, water temperature, or air-fuel ratio, generally used, are recorded as map data.

Figure 3:
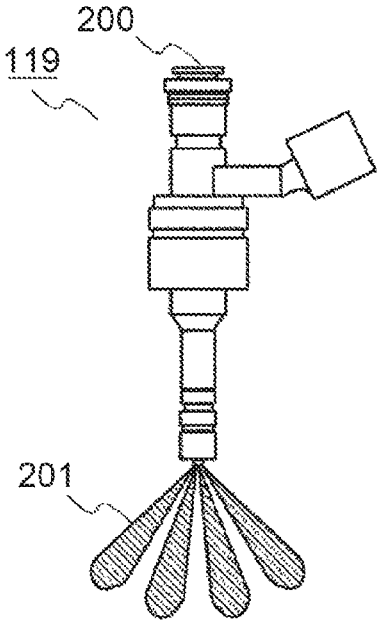
FIG. 3 is a view of an injector according to the first embodiment of the present invention.

FIG. 3 is a diagram illustrating an outline of the injector according to the present embodiment. Fuel is supplied into the injector from a fuel supply port 200. The injector 119 illustrated in FIG. 3 is electromagnetically driven and normally closed, and is configured to seal fuel when there is no current flow. At this time, in the injector for spraying in the cylinder, supplied fuel pressure is in the range of about 1 MPa to 50 MPa. While current is applied, fuel injection is started. When fuel injection is started, energy given as fuel pressure is converted into kinetic energy, reaches an empty fuel injection hole defined at a lower end of the injector, and is injected. The injected fuel is atomized by a shearing force with the atmosphere to form fuel spray 201.

Figure 4:
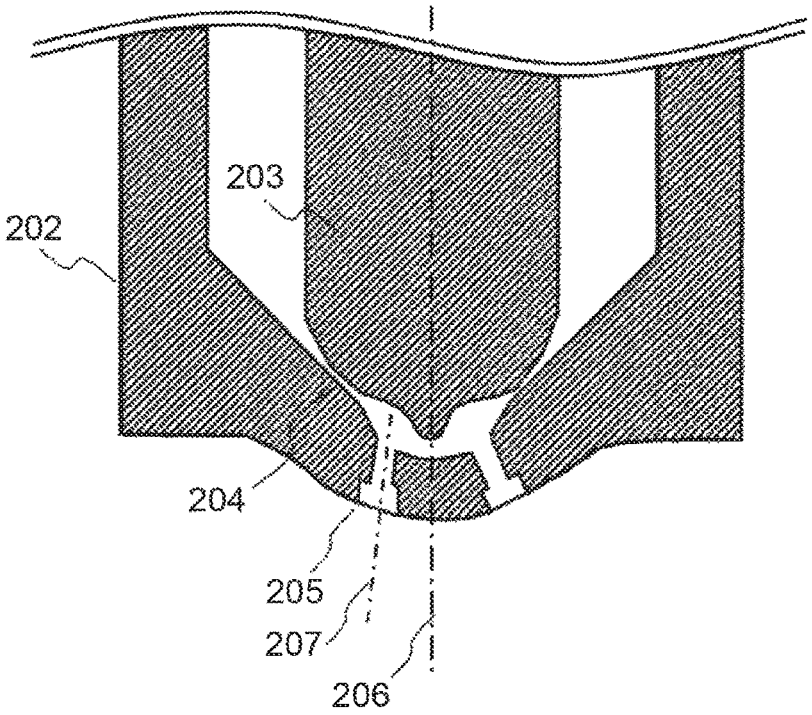
FIG. 4 is an enlarged cross-sectional view of a lower end portion of the injector according to the first embodiment of the present invention.

Next, the detailed shape of the injector will be described with reference to FIG. 4. FIG. 4 is an enlarged sectional view of a lower end portion of the injector including a seat member 202, a valve body 203, and the like. The seat member 202 includes a valve seat surface 204 and a plurality of fuel injection holes 205. The valve seat surface 204 and the valve body 203 extend axially symmetrically around a center axis 206 of the valve body. The fuel passes through a gap between the seat member 202 and the valve body 203 and is injected from the injection holes 205. The fuel is injected toward an injection hole axis 207 of the injection hole.

Figure 5:
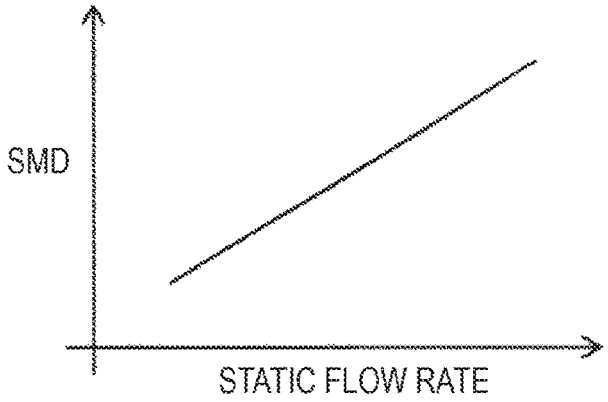
FIG. 5 is a graph illustrating a relationship between the static flow rate of an injector according to the first embodiment of the present invention and the SMD of fuel droplets sprayed from the injector.

Injected fuel droplets have a Sauter mean particle diameter (SMD) determined by the nozzle configuration of the injector, fuel pressure, or the like. FIG. 5 illustrates a relationship between static flow rate representing a maximum flow rate of an injector at a constant fuel pressure and SMD representing a particle diameter in fuel spray. Under use conditions as a general injector, when increasing the static flow rate, the SMD tends to increase because the diameter of a fuel injection hole 205 is increased. Conversely, when reducing the static flow rate, SMD decreases because the diameter of the fuel injection hole 205 is reduced. Injectors with different static flow rates can be manufactured by appropriately setting the nozzle configuration.

In the present embodiment, an injector with a small static flow rate is set as the first injector 119 in FIG. 2, and an injector with a large static flow rate as the second injector 121 in FIG. 2. However, the present invention does not limit the arrangement of the injectors having different static flow rates. That is, an injector with a small static flow rate may be arranged at the position of the injector 121 in FIG. 2 and an injector with a large static flow rate may be arranged at the position of the injector 119 in FIG. 2.

Figure 6:
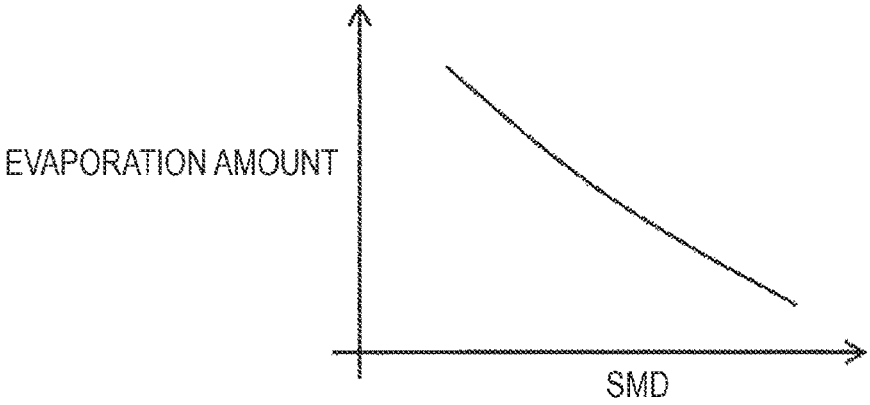
FIG. 6 is a graph illustrating a relationship between the SMD and the evaporation amount of fuel droplets sprayed from an injector according to the first embodiment of the present invention.

FIG. 6 schematically illustrates a relationship between SMD and evaporation amount of fuel droplets. FIG. 6 shows that the evaporation amount tends to increase as the SMD is reduced. This is because the smaller the SMD is, the larger the surface area where fuel and air come in contact with each other is, and evaporation is promoted. In other words, it can be said that the injector with a small static flow rate has better vaporization performance.

Figure 7:
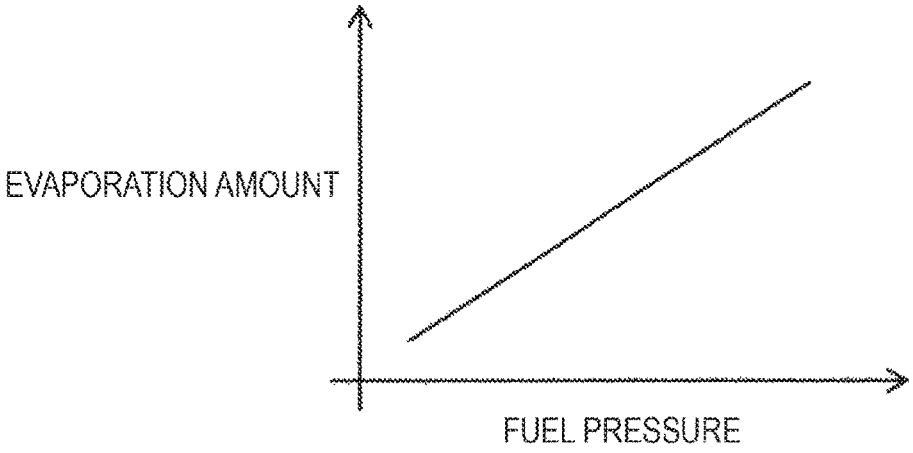
FIG. 7 is a graph illustrating a relationship between the pressure and evaporation amount of fuel, in an injector according to the first embodiment of the present invention.

At the start of the engine, fuel pressure is low. The fuel pressure is monitored by the fuel pressure sensor 113 and is fed back to control fuel injection. FIG. 7 schematically illustrates a relationship between the pressure and evaporation amount of fuel. Generally, when injection is performed in a state where fuel pressure is low, shearing with air is weakened, so that atomization is insufficient and the amount of fuel evaporated tends to decrease.

Figure 8:
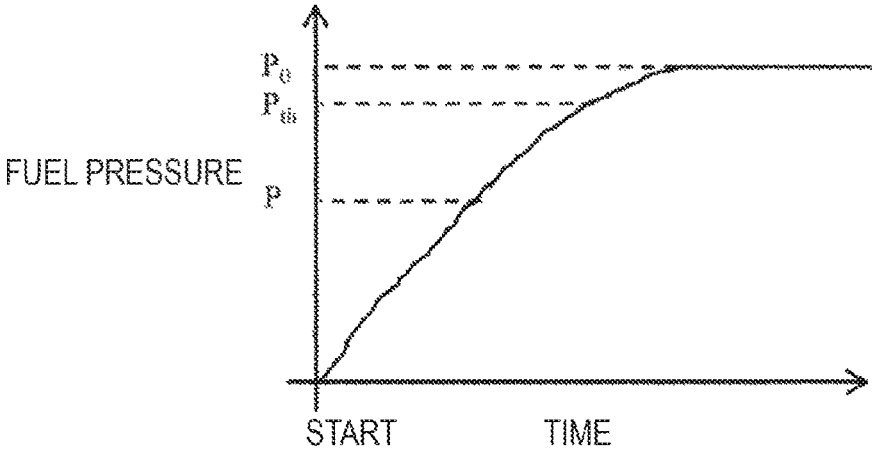
FIG. 8 is a graph illustrating a change in fuel pressure upon starting the internal combustion engine according to the first embodiment of the present invention.

FIG. 8 illustrates an example of a change in fuel pressure in warming up operation from the start of the internal combustion engine. The fuel pressure rises from the start of the internal combustion engine and reaches a fuel pressure $P_0$ in warming up after a certain period of time. Here, to start the internal combustion engine earlier, it is considered to control injection of fuel at a fuel pressure P. From FIG. 7, when the fuel pressure P is low, it can be considered that a decrease in the evaporation amount is substantially proportional to a difference between $P_0$ and P. In view of this, the injection amount of the injector having excellent vaporization performance is controlled to increase to compensate for a decrease in the evaporation amount due to a decrease in fuel pressure, achieving reliable ignition even when the fuel pressure decrease.

Here, as described above, the pressure of fuel supplied by a pressurizing unit (the high-pressure fuel pump 111) is monitored by the fuel pressure sensor 113. Furthermore, the static flow rate of the first injector 119 is smaller than the static flow rate of the second injector 121. When the fuel pressure of fuel supplied by the pressurizing unit is lower than a set value $P_{th}$ set lower than a fuel pressure $P_0$ in warming up, the control unit (ECU 118) according to the present embodiment controls the injection ratio of fuel from the first injector 119 to increase according to a difference between the fuel pressure and the fuel pressure $P_0$ in warming up. Thus, it is possible to compensate for a decrease in the evaporation amount due to a decrease in the fuel pressure, achieving reliable ignition even in spraying at a low fuel pressure.

A specific example of control of the injection amount will be described below. When the injection amounts of the injector 119 and the injector 121 at fuel pressure in warming up are $Q_{119}$ and $Q_{121}$ respectively, the injection ratio is expressed as $R_{119}:R_{121}=Q_{119}:Q_{121}$. The injection amount and the injection ratio are determined by engine speed and torque required. Immediately after the start of operation of the engine, a torque required for the engine is large, and a homogeneous air-fuel mixture of theoretical mixture concentration is required. Since a larger amount of momentum is required for spraying fuel, control is preferably performed so as to inject fuel mainly from an injector with a large static flow rate to favorably disperse the fuel. In other words, the injection ratio should be close to 0:1. Furthermore, when performing operation with weak stratified charge combustion in which a dense fuel distribution is generated around the spark plug during the catalyst warm-up operation, the injection amount of the injector 119 near the spark plug is desirably increased to obtain a value close to 0.5:0.5. These injection ratios are stored, as map data, in the ROM of the ECU.

The injection ratio calculated on the basis of the map data is defined as an optimum value at the pressure $P_0$ in warming up. Here, when the fuel pressure is $P<P_{th}$, the injection ratio of the injector 119 is caused to increase by $\Delta R=A\times(P_0-P)+B$, and the injection ratio of the injector 121 is caused to decrease by $\Delta R$, changing the injection ratio without changing a total amount. Where A and B are optimized constants. On the basis of the determined injection amount, the valve opening time of each injector is determined. In the present invention, a function for determining $\Delta R$ is not limited to a linear function. Alternatively, $P_{th}$ may be used instead of $P_0$, giving $\Delta R=A\times(P_{th}-P)+B$.

In this way, by determining the injection ratio by a function of $P_0-P$, even when the fuel pressure is low, a decrease in the evaporation amount due to a decrease in the fuel pressure can be compensated for by increasing the injection amount of the injector with good evaporation performance, and reliable ignition can be achieved.

Figure 9:
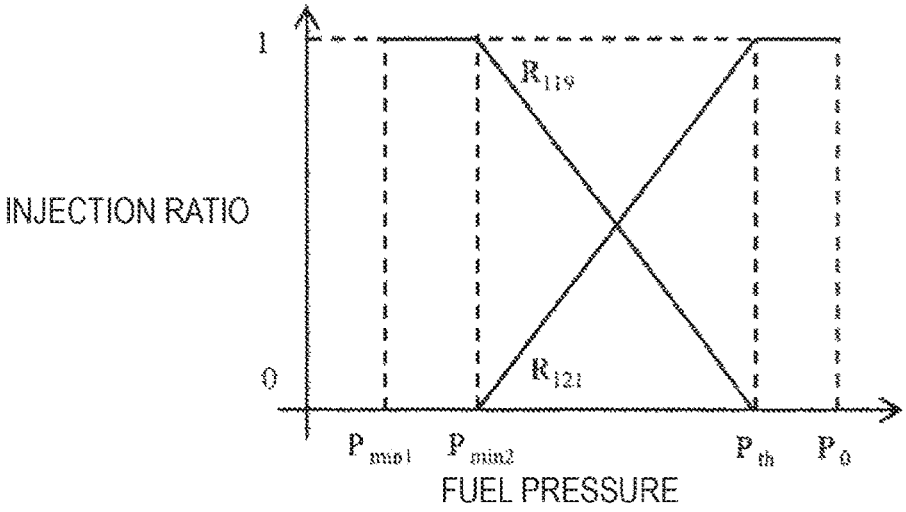
FIG. 9 is a graph illustrating a relationship between the pressure and the injection ratio of fuel in the internal combustion engine according to the first embodiment of the present invention.

An example of the injection amount of the injector will be described with reference to FIG. 9. FIG. 9 illustrates an example of a relationship between the fuel pressure and both of the injection ratio $R_{119}$ of the injector 119 with a small static flow rate and the injection pressure ratio $R_{121}$ of the injector 121 with a large static flow rate. Here, it is assumed that $R_{119}:R_{121}=0:1$ at the pressure $P_0$ in warming up, and that all the injection amounts are calculated from the map data in the ROM so as to be performed from the injector 121 having a large static flow rate. Minimum fuel pressure for injecting fuel is set to the injector, where the minimum fuel pressure of the injector 119 is $P_{min\ 1}$, and the minimum fuel pressure from the injector 121 is $P_{min\ 2}$.

When the fuel pressure P is higher than a fuel pressure threshold $P_{th}$ smaller than the fuel pressure $P_0$ in warming up, no correction is made. In the present embodiment, control is performed so that $R_{119}:R_{121}=0:1$.

When the fuel pressure P is smaller than $P_{th}$, correction is made. Here, $R_{119}$ is controlled to increase by $\Delta R=(P_{th}-P)/(P_{th}-P_{min\ 2})$ to control $R_{121}$ to decrease by $\Delta R$. Since injectors with low static flow rate are excellent in atomization, injection is possible even at a low fuel pressure, and in general there is a relationship of $P_{min\ 1}<P_{min\ 2}$. Here, when the fuel pressure P is $P_{min\ 1}<P<P_{min\ 2}$, the fuel is injected from the injector 119, but is not allowed to be injected from the injector 121. Therefore, all injection amount is desirably ejected from the injector 119 so that $R_{119}:R_{121}=1:0$ is obtained.

When an injectable amount $Q_{max1}$ of the injector 119 having a small static flow rate is less than a required injection amount $Q_{req}$, the injection amount becomes insufficient by a difference $\Delta Q=Q_{req}-Q_{max1}$ between the required injection amount and the injectable amount. In that case, the injector 121 with a large static flow rate may be controlled to inject fuel by $\Delta Q$ so as to compensate for the insufficiency.

In the present embodiment, the injector with a small static flow rate is the first injector 119 in FIG. 2, but the SMDS of droplets sprayed from the injectors may be measured to define an injector having a small SMD as the injector 119 in FIG. 2, and an injector having a large SMD as the injector 121 in FIG. 2.

The present embodiment is configured so that the average particle diameter of fuel droplets ejected from the first injector 119 is smaller than the average particle diameter of fuel droplets ejected from the second injector 121. When the fuel pressure of fuel supplied by the pressurizing unit (high-pressure fuel pump 111) is lower than the set value $P_{th}$ set lower than the fuel pressure $P_0$ in warming up, the control unit (ECU 118) for a fuel injection valve according to the present embodiment controls the injection ratio of the first injector 119 to increase according to a difference between the fuel pressure of the pressurizing unit (high-pressure fuel pump 111) and the fuel pressure in warming up. Thus, it is possible to compensate for a decrease in the evaporation amount due to a decrease in the fuel pressure by increasing the injection amount of the injector with good evaporation performance, and reliable ignition can be achieved.

Second Embodiment

Figure 10:
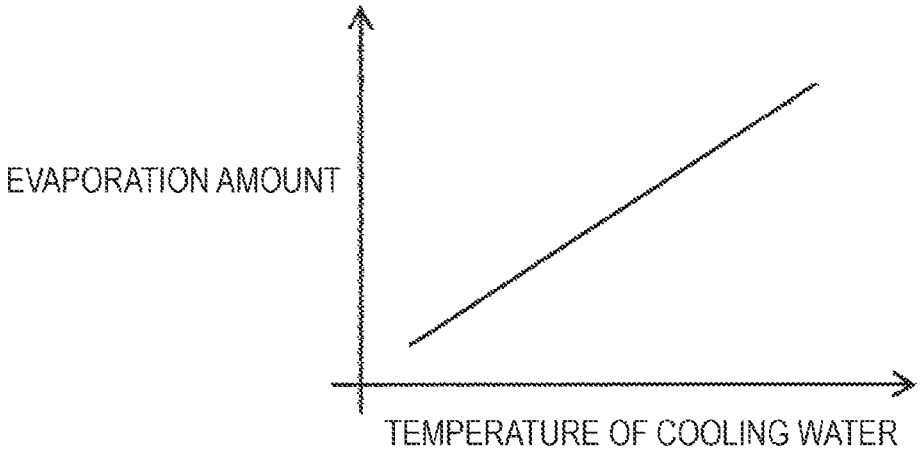
FIG. 10 are graphs illustrating a relationship between the temperature of cooling water and the evaporation amount of sprayed fuel droplets, and a relationship between the temperature of cooling water and the injection ratio of fuel, in the internal combustion engine according to the first embodiment of the present invention.
Figure 10:
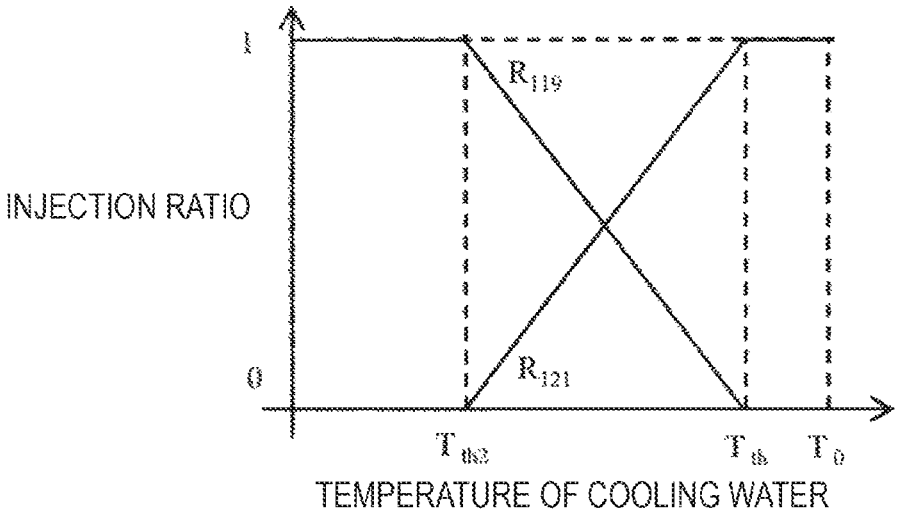

A control unit for an injector according to a second embodiment of the present invention will be described with reference to FIG. 10. FIG. 10(*a*) illustrates a relationship between the temperature of cooling water and the evaporation amount of sprayed fuel droplets. Cooling water flows in a cylinder head 101 and a cylinder block 102 of an engine to cool the engine. When the temperature of cooling water is low, the temperature of the engine is low, and the evaporation amount decreases. The temperature of cooling water is monitored by a non-illustrated temperature sensor.

Here, when the temperature of cooling water is lower than a temperature threshold $T_{th}$ set lower than temperature $T_0$ in warming up and $T<T_{th}$, the injection ratio of an injector 119 is caused to increase by $\Delta R=A_2\times(T_0-T)+B_2$, and the injection ratio of an injector 121 is caused to decrease by $\Delta R$, thereby changing the injection ratio without changing a total injection amount. Thus, even when the temperature in the engine is low, a decrease in the evaporation amount due to a decrease in temperature can be compensated for by an increase in the injection amount of an injector with good evaporation performance, and reliable ignition can be achieved. Note that $T_{th}$ may be used instead of $T_0$ and $\Delta R=A_2\times(T_{th}-T)+B_2$.

In the present embodiment, as described above, the temperature of cooling water of the engine is monitored by a non-illustrated temperature sensor. In addition, the static flow rate of the first injector 119 is configured to be smaller than the static flow rate of the second injector 121. When the temperature of cooling water is lower than a set value $T_{th}$ set lower than the temperature $T_0$ of cooling water in warming up, the control unit (ECU 118) for a fuel injection valve according to the present embodiment controls the injection ratio of the first injector to increase according to a difference between the temperature of cooling water and the temperature of cooling water in warming up. As a result, reliable ignition can be achieved even when the temperature of cooling water is low.

FIG. 10(*b*) illustrates an example of correction control of the injection ratio according to the temperature of cooling water. Here, it is assumed that $R_{119}:R_{121}=0:1$ at temperature $T_0$ in warming up, and that all the injection amounts are calculated from map data in a ROM so as to be performed from the injector 121 having a large static flow rate.

When the temperature T of cooling water is higher than the temperature threshold $T_{th}$ smaller than $T_0$, no correction is made. That is, control is performed so that $R_{119}:R_{121}=0:1$.

When the temperature T of cooling water is smaller than $T_{th}$, correction is made. Here, when the temperature T of cooling water is higher than a second temperature threshold $T_{th2}$ set lower than $T_{th}$, control is performed so that $R_{119}$ is increased by $\Delta R=(T_{th}-T)/(T_{th}-T_{th2})$ and $R_{121}$ is decreased by $\Delta R$.

Furthermore, when $T<T_{th2}$, control is performed so that all the injection amounts are injected from the injector 119, and the evaporation amount can be maximized when $R_{119}:R_{121}=1:0$.

Third Embodiment

Figure 11:
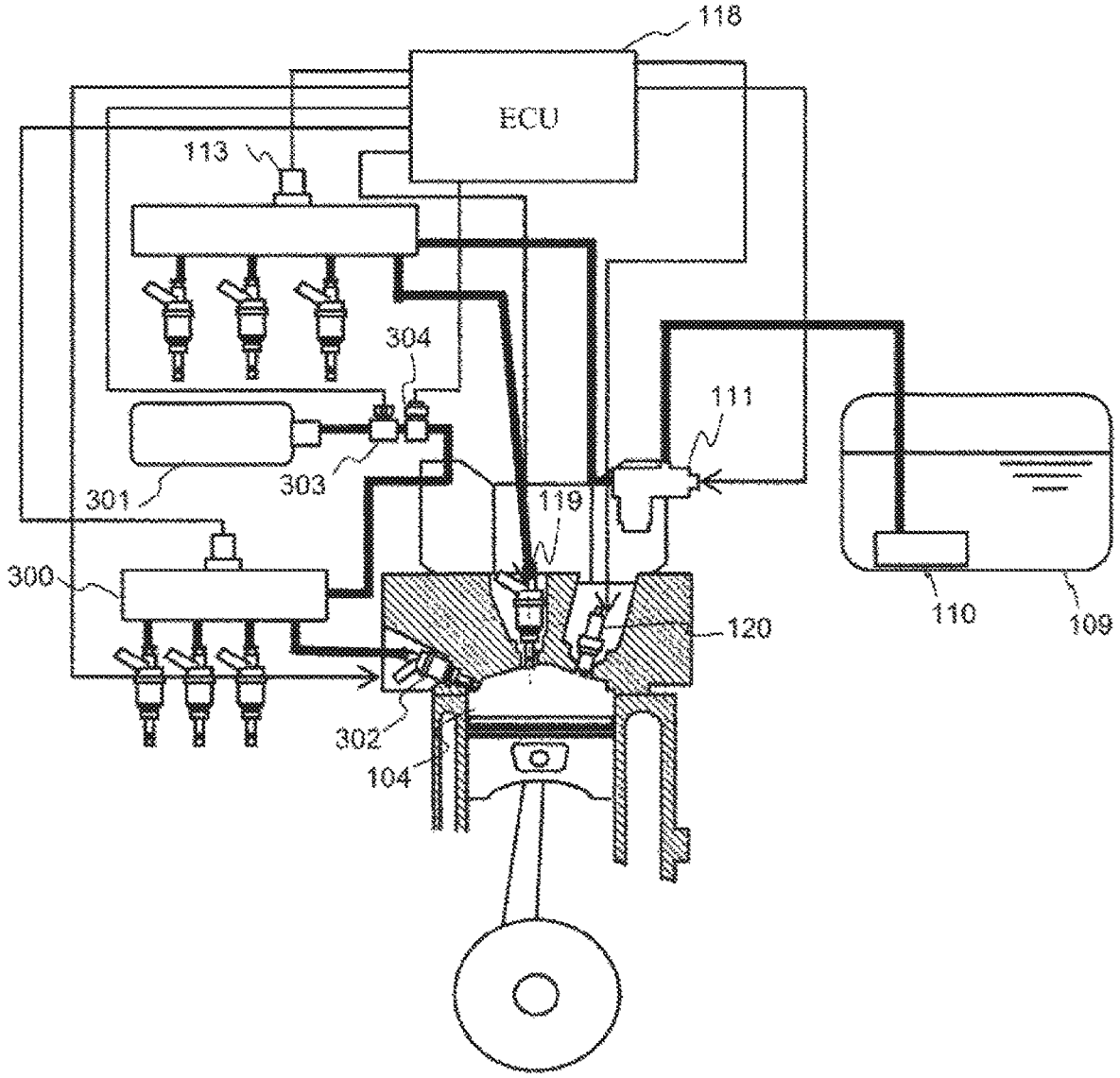
FIG. 11 is a diagram illustrating an outline of a configuration of an internal combustion engine according to a third embodiment of the present invention.

A control unit for an injector according to a third embodiment of the present invention will be described below with reference to FIG. 11. The third embodiment illustrated in FIG. 11 includes a gas fuel injector 302 separated from an injector 119, a common rail 300 for injecting gas fuel, a tank 301 for storing gas fuel, a pressure regulating valve 303 for regulating a flow rate of gas fuel, and a flowmeter 304. The other configurations are the same as those in the first embodiment. From the gas fuel injector 302, for example, a gas fuel such as CNG is injected. The injection ratio of the injector 119 and the gas fuel injector 302 is stored as map data in a ROM of an ECU.

The injection ratio calculated on the basis of the map data is defined as an optimum value at a fuel pressure $P_0$ in warming up operation. Here, when the fuel pressure is $P<P_{th}$, the injection ratio of the injector 302 is caused to increase by $\Delta R=A_3\times(P_0-P)+B_3$, and the injection ratio of the injector 119 is caused to decrease by $\Delta R$. On the basis of the determined injection amount, the valve opening time of each injector is determined. In this way, determining the injection ratio by a function of $P_0-P$ enables reliable ignition can be achieved by securing gas fuel even when the fuel pressure is low. Note that $P_{th}$ may be used instead of $P_0$, giving $\Delta R=A_3\times(P_{th}-P)+B_3$.

In the present embodiment, at least one of the injectors is a gas injector 302 configured to inject gas fuel. Then, the fuel pressure P of fuel supplied by the pressurizing unit (high-pressure fuel pump 111) is lower than the set value $P_{th}$ set lower than the fuel pressure $P_0$ in warming up, the control unit (ECU 118) for a fuel injection valve according to the present embodiment controls the fuel injection ratio of the gas injector 302 to increase to increase according to a difference between the fuel pressure P and the fuel pressure $P_0$ in warming up. Thus, it is possible to compensate for a decrease in the evaporation amount due to a decrease in the fuel pressure by increasing the injection amount of gas fuel, and reliable ignition can be achieved.

Fourth Embodiment

A control unit for an injector according to a fourth embodiment of the present invention will be described below. The fourth embodiment has a configuration similar to that of the first embodiment. In the present embodiment, an operating condition for injection from an injector other than an injector with a small static flow rate when fuel pressure has sufficiently increased is considered. For example, for homogeneous combustion in which fuel is homogeneously dispersed in the engine cylinder, it is assumed that fuel is injected mainly from an injector with a large static flow rate and good dispersibility, and the fuel pressure at this time is $P_0$.

Furthermore, when the fuel pressure is high, the loss of the pressurizing unit increases. Therefore, it is preferable to set the fuel pressure to a minimal value.

The fuel pressure may be controlled to be reduced by increasing the injection ratio of the injector with a small static flow rate and increasing the evaporation amount. Thus, it is possible to reduce the loss of the pressurizing unit by lowering the fuel pressure while securing sufficient evaporation performance.

For example, when the injection ratio of the first injector 119 having a small static flow rate to the second injector 121 having a large static flow rate is $R_{119}:R_{121}=0:1$ at the fuel pressure $P_0$, the injection ratio of fuel from the first injector 119 is caused to increase by $\Delta R$, and the fuel injection ratio of the injector 121 is caused to decrease by $\Delta R$. That is, $R_{119}:R_{121}=\Delta R:1-\Delta R$. Here, by controlling the fuel pressure to decrease according to $\Delta R$, it is possible to reduce the loss of the pressurizing unit while securing a sufficient evaporation amount.

In the present embodiment, the static flow rate of the first injector 119 is configured to be smaller than the static flow rate of the second injector 121. Then, the control unit (ECU 118) for a fuel injection valve according to the present embodiment controls the injection ratio of the first injector 119 to increase relative to a predetermined ratio and the fuel pressure of fuel from the pressurizing unit (high-pressure fuel pump 111) to decrease according to a difference in injection ratio. Thereby, it is possible to reduce the loss of the pressurizing unit and reduce fuel consumption.

REFERENCE SIGNS LIST

101 cylinder head
102 cylinder block

103 piston
104 combustion chamber
105 intake pipe
106 exhaust pipe
107 intake valve
108 exhaust valve
109 fuel tank
110 feed pump
111 high-pressure fuel pump
112 common rail
113 fuel pressure sensor
114 connecting rod
115 crankshaft
116 crank angle sensor
117 water temperature sensor
118 ECU
119 fuel injection valve
120 spark plug
121 fluid injection valve (an agitation fuel injection valve in the first embodiment)
200 fuel supply port
201 fuel spray
202 seat member
203 valve body
204 valve seat surface
205 injection hole
206 axis of valve body
207 axis of injection hole
300 common rail
301 gas fuel tank
302 gas fuel injector
303 pressure regulating valve
304 flowmeter

The invention claimed is:

1. A controller configured to control an injector injecting fuel into an internal combustion engine, wherein a plurality of injectors is provided in the internal combustion engine, and wherein a static flow rate of a first injector of the plurality of injectors is smaller than a static flow rate of a second injector of the plurality of injectors, the controller configured to:

when a fuel pressure of fuel supplied by a pressurizing unit is determined to be lower than a set value, the set value being lower than a fuel pressure during warm-up of the internal combustion engine, control an injection ratio of the first injector to increase according to a difference between a fuel pressure from the pressurizing unit and a fuel pressure during warm-up of the internal combustion engine, wherein the controller is configured to, when the fuel pressure is less than a threshold value, control the injection ratio of the first injector to increase by an amount, and control the injection ratio of the second injector to decrease by the amount.

2. A controller configured to control an injector injecting fuel into an internal combustion engine, wherein a plurality of injectors is provided in the internal combustion engine, an average particle diameter of fuel droplets ejected from a first injector of the plurality of injectors is smaller than an average particle diameter of fuel droplets ejected from a second injector of the plurality of injectors, the controller configured to:

when a fuel pressure of fuel supplied by a pressurizing unit is determined to be lower than a set value, the set value being lower than a fuel pressure during warm-up of the internal combustion engine, control an injection ratio of the first injector to increase according to a difference between a fuel pressure from the pressurizing unit and a fuel pressure during warm-up of the internal combustion engine.

* * * * *